US008322568B2

(12) United States Patent
Cattacin et al.

(10) Patent No.: US 8,322,568 B2
(45) Date of Patent: Dec. 4, 2012

(54) SHEET PRODUCT DISPENSER

(75) Inventors: Gilles Cattacin, Colmar (FR); Nicolas Pommier, Colmar (FR); Brian K. Linstedt, Ostrander, OH (US); Sally A. Stark, Westerville, OH (US); Timothy C. Rothwell, Dublin, OH (US); Luke C. Stonis, Columbus, OH (US)

(73) Assignee: Georgia-Pacific France (FR)

( * ) Notice: Subject to any disclaimer, the term of this patent is extended or adjusted under 35 U.S.C. 154(b) by 357 days.

(21) Appl. No.: 12/268,688

(22) Filed: Nov. 11, 2008

(65) Prior Publication Data

US 2009/0120952 A1 May 14, 2009

(30) Foreign Application Priority Data

Nov. 13, 2007 (EP) ..... 07291356

(51) Int. Cl.
*G07F 11/72* (2006.01)

(52) U.S. Cl. ..... 221/154; 221/45

(58) Field of Classification Search ..... 221/33, 221/37, 42, 45, 61, 62, 65, 151, 154, 208, 221/246, 247, 268, 277, 312 A, 312 C
See application file for complete search history.

(56) References Cited

U.S. PATENT DOCUMENTS

| | | | | |
|---|---|---|---|---|
| 2,150,817 | A * | 3/1939 | Boex | 221/48 |
| 2,195,727 | A * | 4/1940 | Jensen | 221/62 |
| 2,639,959 | A * | 5/1953 | Couden | 221/43 |
| 3,124,268 | A * | 3/1964 | Krueger | 221/36 |
| 3,841,466 | A * | 10/1974 | Hoffman et al. | 206/205 |
| 4,546,898 | A * | 10/1985 | Ekuan | 206/737 |
| 4,662,664 | A | 5/1987 | Wendt et al. | |
| 5,273,184 | A | 12/1993 | Rizzuto | |
| 5,549,218 | A * | 8/1996 | Asmussen | 221/282 |
| 5,857,642 | A * | 1/1999 | Zinnbauer | 242/590 |
| 6,619,504 | B2 * | 9/2003 | Ozimec | 221/115 |
| 6,695,246 | B1 | 2/2004 | Elliott et al. | |
| 2002/0056526 | A1 * | 5/2002 | Kelders et al. | 156/577 |
| 2002/0096596 | A1 * | 7/2002 | Adelakun | 242/570 |
| 2006/0157496 | A1 * | 7/2006 | Tagliareni | 221/63 |

FOREIGN PATENT DOCUMENTS

| | | | |
|---|---|---|---|
| CH | 635296 | A5 | 3/1983 |
| EP | 0967908 | B1 | 5/2003 |
| EP | 1230886 | B1 | 12/2004 |
| FR | 2667854 | A1 * | 4/1992 |

OTHER PUBLICATIONS

European Search Report and Written Opinion dated May 21, 2008, for European Patent Application No. 07291356.9 filed Nov. 13, 2007.
English machine translation for CH 635296, publication date Mar. 31, 1983, Lingner & Fischer GmbH.

* cited by examiner

*Primary Examiner* — Gene Crawford
*Assistant Examiner* — Kelvin L Randall, Jr.
(74) *Attorney, Agent, or Firm* — Joel T. Charlton

(57) ABSTRACT

A sheet product dispenser includes a housing comprising a dispenser opening for dispensing sheet product, and a water resistance means attached to a periphery of the dispenser opening, the water resistance means includes a means for housing the sheet product, a repositionable chute door movable between an open and a closed position, a chute seal between the housing means and the dispenser opening, and at least a door seal between the housing means and the chute door.

9 Claims, 4 Drawing Sheets

SHEET PRODUCT DISPENSER

CROSS REFERENCE TO RELATED APPLICATION

This application claims priority to copending European patent application number 07291356.9, filed Nov. 13, 2007, the disclosure of which is incorporated herein by reference.

BACKGROUND

The present invention relates to the field of dispensers for roll sheet products, such as roll towel product. In particular it relates to an improvement for such dispensers, which render them resistant to water penetration during cleaning procedures.

Roll dispensers are often provided in public or commercial facilities, and subjected to cleaning by a pressure spray of water or other more aggressive component (detergent, cleaning solution). Washing can occur one or more times per day. It is often aimed to prevent the inadvertent spread of bacteria and/or diseases.

During the washing, liquid may penetrate and leak into the dispensers, resulting in products placed in the dispenser to become wet. If the product is a roll of paper towel, it is wasted. Additionally, jamming of the dispenser can occur, leading to the roll having to be removed and disposed by the maintenance people, which is costly.

Furthermore, components in the dispenser may be damaged by a dried cleaning solution that has leaked inside, which can cause the dispenser to be less likely to operate properly.

Also water and/or liquid cleaning solution that leaks inside the dispenser may carry bacteria or other pathogens as well.

Accordingly, a continual need exists for sheet product dispensers having enhanced water or liquid resistance.

BRIEF SUMMARY

Disclosed herein are sheet product dispensers.

In one embodiment, a sheet product dispenser includes a housing comprising a dispenser opening for dispensing sheet product, and a water resistance means attached to a periphery of the dispenser opening, the water resistance means includes a means for housing the sheet product, a repositionable chute door movable between an open and a closed position, a chute seal between the housing means and the dispenser opening, and at least a door seal between the housing means and the chute door.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

The present invention overcomes the problem of washdown and wet environments of dispenser for roll sheet product (also referred to as web product), by eliminating liquid penetration into the dispenser in a very simple and reliable way.

In other words, the invention is an apparatus (system) adapted for use with a dispenser to render the dispenser fully and securely water resistant and dispenser comprising this apparatus that provides a means for enhancing water or liquid resistance.

As used herein, the term "dispenser opening" is the opening of a dispenser; it is placed in the bottom face of the dispenser when this latter is fixed on a vertical wall; the term "chute door" is the element that closes the system when a washdown occurs; the term "housing means" refers to an element attached to the dispenser bottom face, which contains and guides the paper out of the dispenser opening; and the term "sheet product" means a sheet material such as paper tissue, paper toweling, toilet paper, label rolls, which exhibits a relatively flat planar configuration and is flexible to permit folding, rolling, stacking and the like.

In one embodiment, the system for enhancing the water resistance of a roll dispenser, to be attached to the dispenser opening comprises a means for housing the paper, attached to the periphery of the dispenser opening; a repositionable chute door movable between an open and a closed position; a paper chute seal between the housing means and the dispenser opening; and at least a door seal between the housing means and the chute door.

Such a system is releasably coupled to a roll dispenser. Preferably, the chute door is rotatable.

In one embodiment, the housing means comprises a semi cylindrical portion prolonged by a parallelepipedic over portion; two flanges provided with lock detents cooperating with protrusions of the chute door; and with an outer protrusion used as a rotation axle for the chute door. The flanges are provided with grooves between lock detents, to guide the chute door between the open and the closed position.

The chute housing is provided with an outer recess for sliding (placing) the chute door at the open position. Advantageously, the chute door is provided with a holding means, for manually displacing it between the open and the closed positions. The chute door cooperates with a first elongated door seal when in open position, and with both the first and a second elongated door seal when in closed position. This cooperation makes the system quite reliable as far as the sealing is concerned, whatever the outside conditions are. Preferably, the door seals are made of foamed rubber. Other convenient material can be used. Conveniently, the door seals are housed in elongated outer grooves of the chute housing. Furthermore, a paper chute seal is provided, and compressed between the under peripheric surface of the system and the upper surface of the dispenser opening and/or the upper surface of the front cover.

Figure 1:
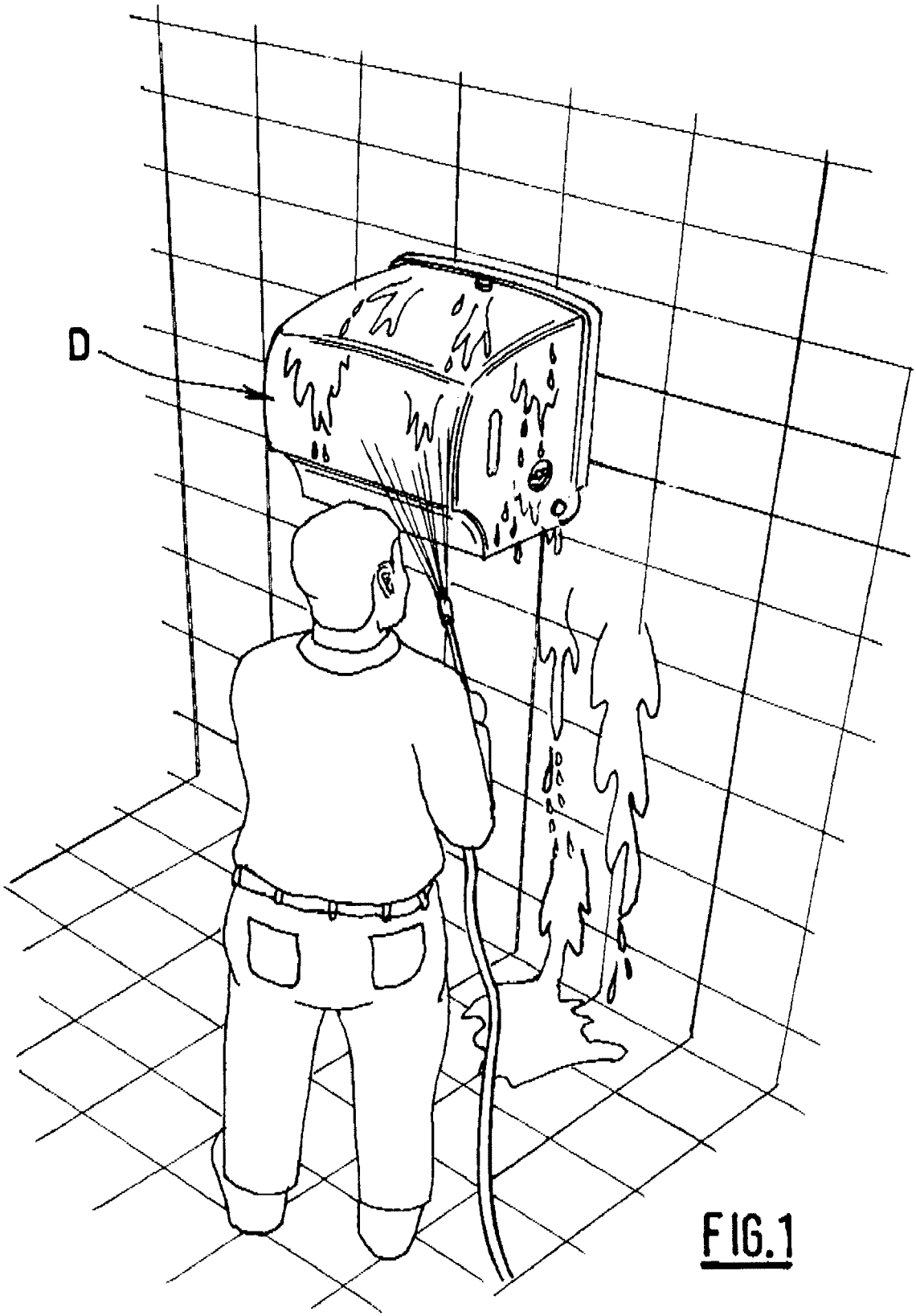
FIG. 1 is a perspective view of a roll web dispenser mounted to a wall during a washdown procedure.

FIG. 1 shows a dispenser, D, undergoing a washing, which can take place in industrial food preparation facilities, public washrooms, outside wet environments, and the like where strong spraying occurs against the dispenser.

Figure 2B:
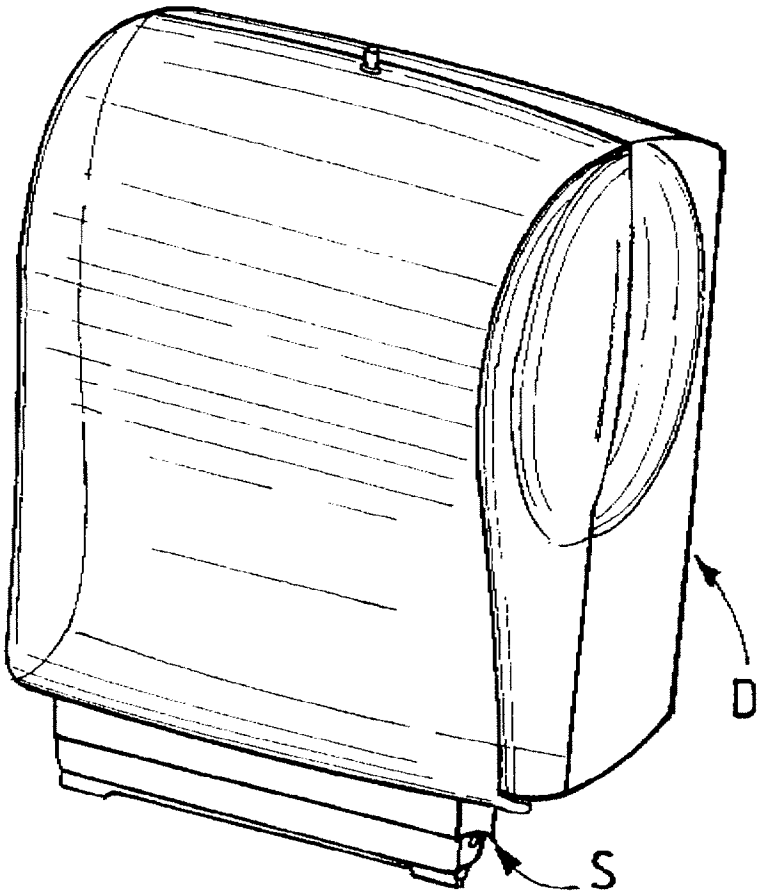
FIG. 2B is a perspective view of a dispenser with a means for enhancing water or liquid resistance according to the invention in a washdown position.
Figure 2A:
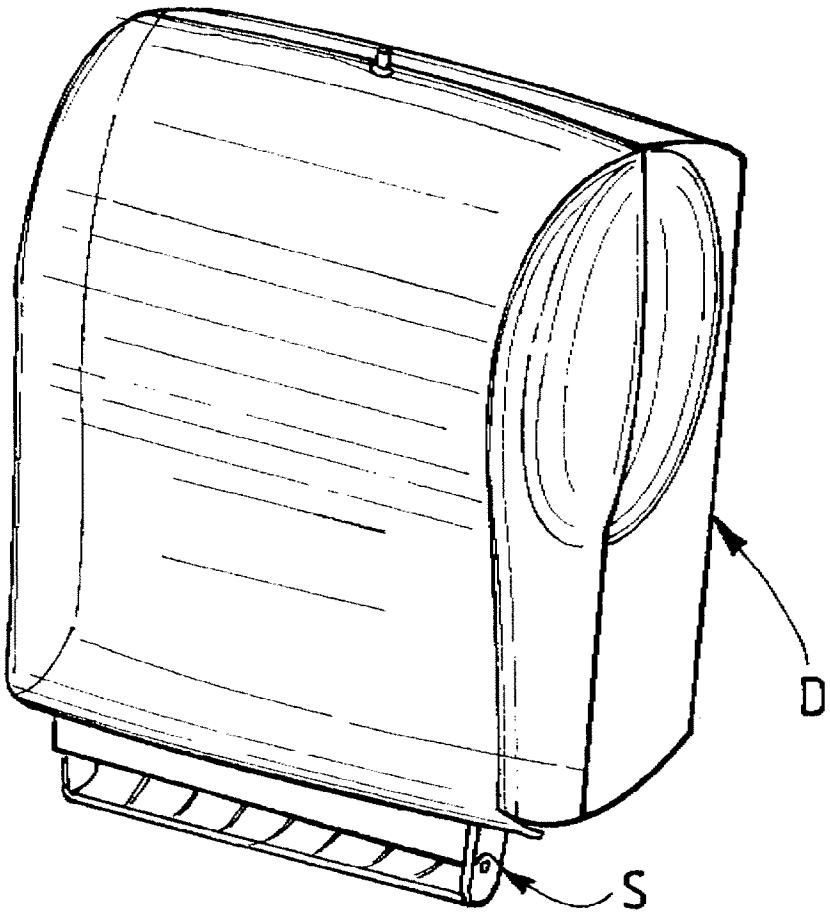
FIG. 2A is a perspective view of a dispenser with a means for enhancing water or liquid resistance according to the invention in the normal operating position.

As visible, FIG. 2A relates to the system S in a normal operating position i.e. a dispensing position; whereas FIG. 2B deals with the washdown position when the system S is fully closed and sealed to the dispenser D.

The system S can have various shapes. It is necessary sealingly attached to the usual opening of the dispenser which is currently disposed under the dispenser. Other layouts of the opening are within the scope of the invention.

Figure 3B:
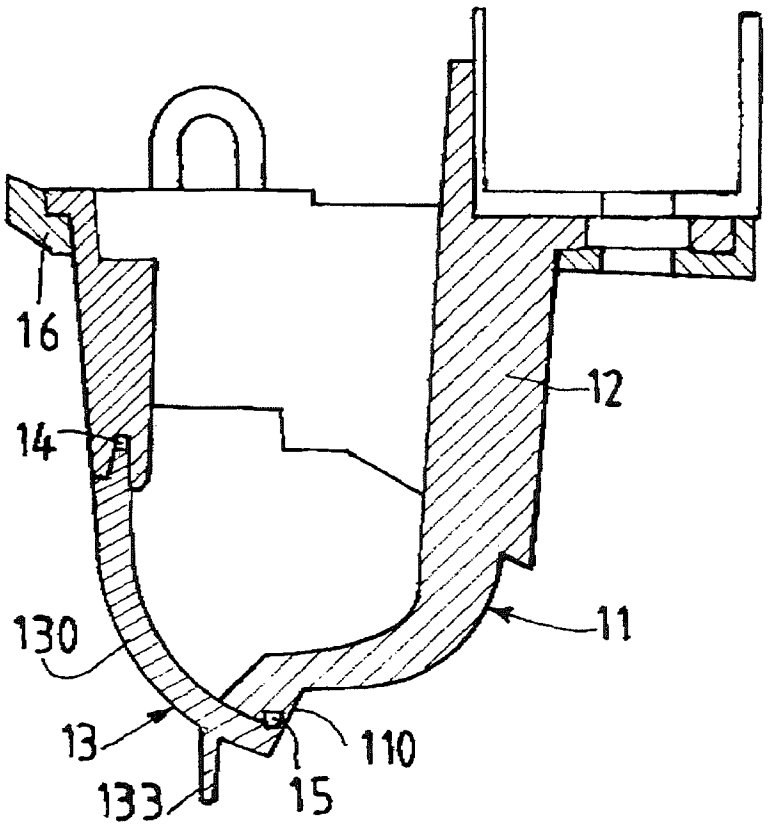
FIG. 3B is a side elevation view of the means for enhancing water or liquid resistance in a washdown position.
Figure 3A:
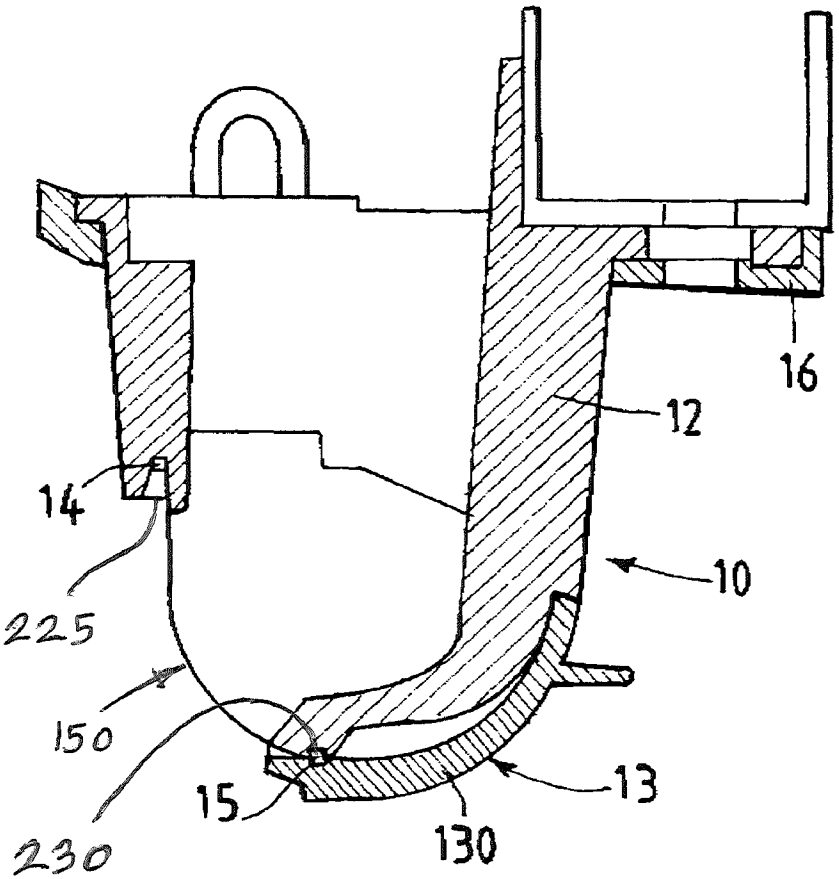
FIG. 3A is a side elevation view of the means for enhancing water or liquid resistance in the normal operating position.
Figure 4:
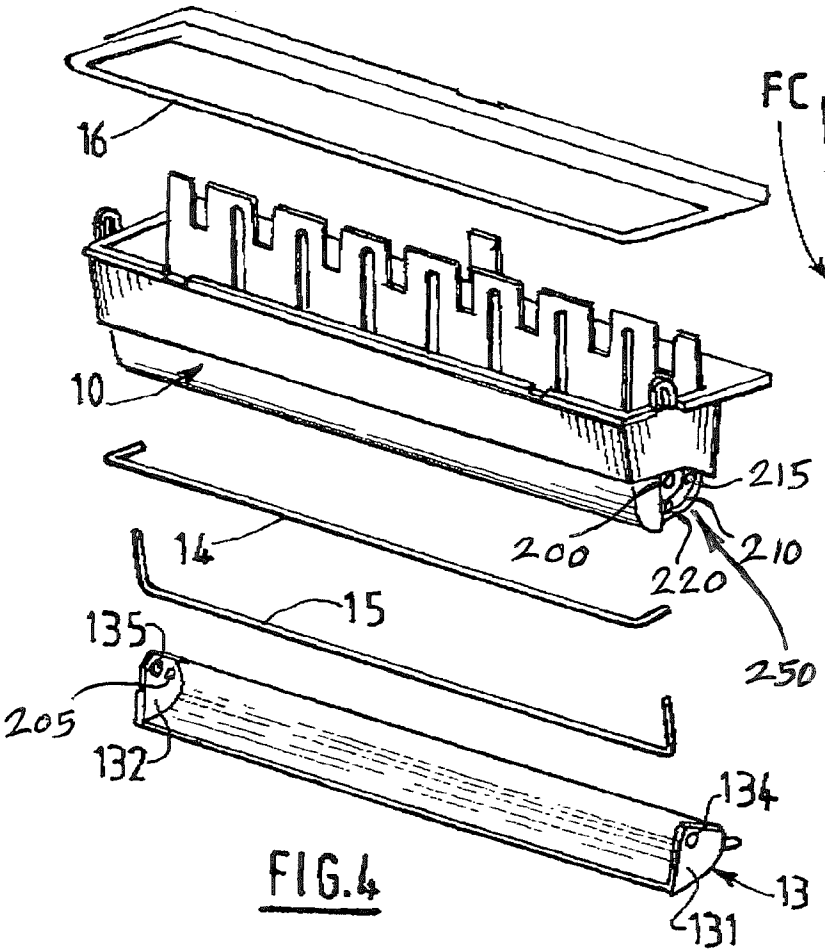
FIG. 4 is an exploded view of an embodiment of a means for enhancing water or liquid resistance.

On FIGS. 3A and 3B as well as on FIG. 4, one can see the different means (pieces) which constitute an embodiment according to the invention.

More precisely, there is a means 10 for housing the paper, alternatively herein referred to as a housing means or a chute housing. It is attached to the periphery of the dispenser opening 140 (see FIG. 5) by any known means.

According to a preferred embodiment, the housing means 10 has a semi cylindrical portion 11 prolonged by a parallelepipedic over portion 12 directly attached to the dispenser opening. The portion 12 is necessary if the system is used with an electronic dispenser which is able to dispense sheets of paper as soon as it detects the proximity of a hand for example. In such a case, at least a sheet can be dispensed when the system is in a closed (washdown) position, and the sheet dispensed correctly, without any jam.

The system enables at least a sheet to be dispensed and temporary stored in the system when in a closed position.

Besides, according to an embodiment, a rotatable chute door 13 is provided, cooperating with the housing means 10, and movable between an open (opening 150, see FIG. 3A) and a closed position.

The open position is shown on FIG. 3A whereas the closed position is the one disclosed on FIG. 3B.

Globally, the chute door 13 comprises a portion of cylinder 130 and two lateral semi circular flanges 131, 132.

The chute door 13 is provided with a holding means 133 for manually displacing it between the open and the closed positions. It rotates around an axle determined by protuberances 200 in the flange 250 of the housing means 10. The protuberances cooperates with respective holes 134, 135 in each flange 131, 132 of the chute door 13.

Each flange 131, 132 of the chute door 13 is further provided with a protrusion 205 (one side referenced, other side not referenced) cooperating with a semi circular groove 210 of the flange 250 of the housing means 10. Additionally, each semi circular groove ends through a hole (lock detents) 215, 220 for positioning a protrusion of the chute door either in the open or in the closed position.

These means respectively guide and position the chute door 13 with respect of the chute housing 10. Any means which fulfill these functions are within the scope of the invention.

According to another feature, the semi-cylindrical portion 11 of the housing means 10 is provided with an outer recess 110 for positioning the chute door at the open position. The recess 110 allows an outer compact shape of the system, when the chute door is in the open position as well as when it is in the closed position.

At least a door seal is provided between the housing means 10 and the chute door 13.

This seal 14, further called "door seal-upper" is aimed to limit the direct water infiltrations inside the chute housing 10. It can be made of foamed rubber, and it has for example a square or circular cross section. It is preferably housed in a groove 225 made in the chute housing, and it runs parallely to the upper edge of the chute door 13.

Another seal 15 can be provided at the lowest part of the chute housing 10, between the chute housing 10 and the chute door 13. It is aimed to avoid water from the wall behind the system to enter inside the system when the chute door is in the closed position.

The second seal 15 can be made of foamed rubber, with a square or circular cross section. It can be housed in a groove 230, or not.

According to another embodiment, the above described seals can be over molded. In this respect, the main piece i.e. the chute door for example is, in a first step, molded through injection. It is provided with small "linking" holes. Then it is transferred to a second mold where the seal is added, positioned and linked thanks to introduction of some of its portions into the "linking" holes of the molded chute door.

Another technical process is the "bi injection", wherein the molding press is provided with two separate nozzles each injecting either the material of the door (polypropylene for example) or the material of the seal (foam for example).

These are different processes for manufacturing either on a single equipment or on different equipments: the chute door, the housing means and their associated seals.

Other seals can be provided, between the system and elements in direct contact with it: for example between the front cover of the dispenser and the system; and between the lower back part of the dispenser and the system.

In particular, a paper chute seal 16 as fully illustrated on FIG. 4, can be provided in this respect.

Figure 5:
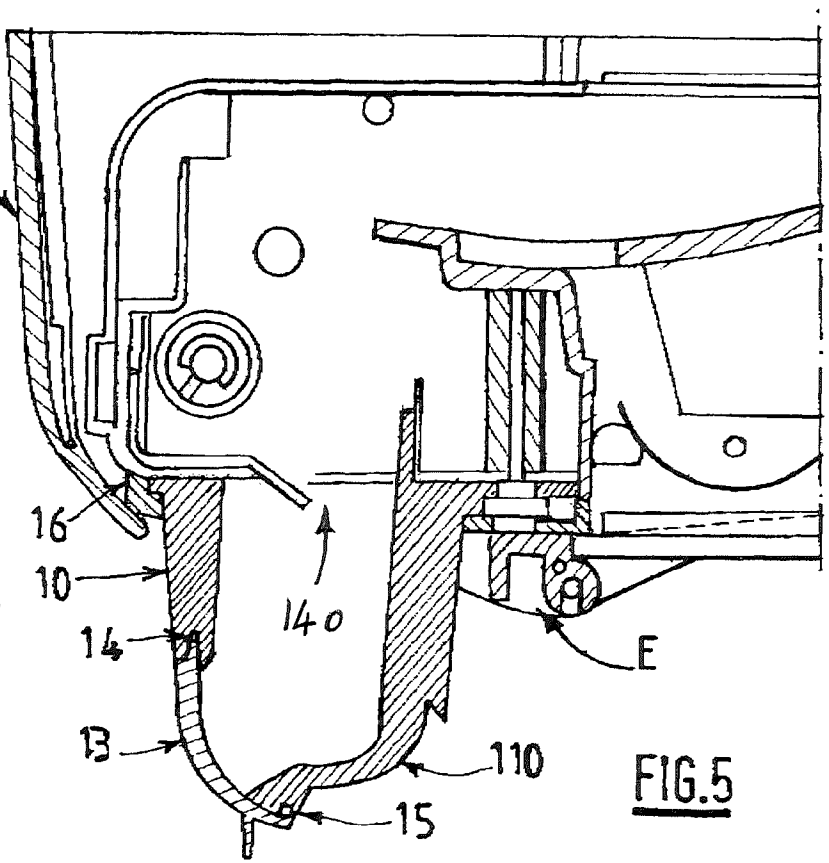
FIG. 5 is a section of dispenser having a means for enhancing water or liquid resistance.

FIG. 5 illustrates an example of connection between a system according to the invention and a known dispenser. The system is placed at the lowest part of the dispenser; it is an additional means that encloses the usual opening. The system rests on existing edges, E, of the opening and on the front cover, FC, of the dispenser. It is attached to the dispenser by any known means.

As seen on FIG. 5, the system, S, according to the invention is tightly fixed under the existing dispenser, and it forms a closed and sealed box when the chute door 13 is closed. Furthermore it is a safe and seal space for storing any sheet that could be dispensed when the chute door 13 is closed.

The above advantages and features render the invention very appropriate for washdowns of dispensers.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A sheet product dispenser comprising:

a housing comprising a dispenser opening for dispensing sheet product, and a water resistance means attached to a periphery of the dispenser opening, the water resistance means comprises a means for housing the sheet product, a repositionable chute door movable between an open and a closed position, a chute seal between the housing means and the dispenser opening, and at least a door seal between the housing means and the chute door;

wherein the housing means comprises:

a semi cylindrical portion prolonged by a parallelepipedic over portion;

two flanges provided with lock detents cooperating with protrusions of the chute door; and with an outer protrusion used as a rotation axle for the chute door.

2. The sheet product dispenser according to claim 1, wherein the flanges are further provided with grooves between lock detents, to guide the chute door between the open and the closed position.

3. The sheet product dispenser according to claim 1, wherein the chute housing is provided with an outer recess for positioning the chute door at the open position.

4. A sheet product dispenser comprising:

a housing comprising a dispenser opening for dispensing sheet product disposed within the housing, and a water resistance apparatus attached to the housing at a periphery of the dispenser opening, the water resistance apparatus comprises:

a body portion comprising a body portion opening, the body portion being disposed for guiding the sheet product dispensed out of the dispenser opening through the body portion opening, a repositionable chute door movable between an open and a closed position relative to the body portion opening, a first seal disposed between the body portion and the housing, and at least a second seal disposed between the bod portion and the chute door;

wherein the body portion comprises:

two flanges provided with lock features cooperating with mating lock features of the chute door, and provided with a pivot feature used as a rotation axle for the chute door.

5. The sheet product dispenser according to claim 4, wherein the two flanges each further comprise grooves extending between the respective lock features to guide the chute door between the open and the closed position.

6. The sheet product dispenser according to claim 4, wherein the body portion further comprises an outer recess for positioning the chute door at the open position.

7. A water resistance apparatus adapted for attachment to a housing of a sheet product dispenser at a periphery of a dispenser opening of the housing, the sheet product dispenser being adapted for holding and dispensing sheet product disposed within the housing, the water resistance apparatus comprising:

a body portion comprising a body portion opening, the body portion being disposed for guiding the sheet product dispensed out of the dispenser opening through the body portion opening, a repositionable chute door movable between an open and a closed position relative to the body portion opening, a first seal disposed between the body portion and the housing, and at least a second seal disposed between the body portion and the chute door;

wherein the body portion comprises:

two flanges provided with lock features cooperating with mating lock features of the chute door, and provided with a pivot feature used as a rotation axle for the chute door.

8. The water resistance apparatus according to claim 7, wherein the two flanges each further comprise grooves extending between the respective lock features to guide the chute door between the open and the closed position.

9. The water resistance apparatus according to claim 7, wherein the body portion further comprises an outer recess for positioning the chute door at the open position.

* * * * *